United States Patent [19]

Turk et al.

[11] 4,160,481

[45] Jul. 10, 1979

[54] METHOD FOR RECOVERING SUBSURFACE EARTH SUBSTANCES

[75] Inventors: L. Jan Turk; Ralph O. Kehle, both of Austin, Tex.

[73] Assignee: The HOP Corporation, Houston, Tex.

[21] Appl. No.: 766,523

[22] Filed: Feb. 7, 1977

[51] Int. Cl.[2] ..... E21B 43/24; E21C 41/10

[52] U.S. Cl. ..... 166/272; 166/50; 166/263; 166/303; 299/2

[58] Field of Search ..... 166/245, 263, 272, 302, 166/303, 50, 57, 62; 299/2, 3, 4, 5, 6

[56] References Cited

U.S. PATENT DOCUMENTS

| | | | |
|---|---|---|---|
| 1,520,737 | 12/1924 | Wright | 166/50 X |
| 1,735,012 | 11/1929 | Rich | 299/2 |
| 2,200,665 | 5/1940 | Bolton | 299/2 |
| 2,365,591 | 12/1944 | Ranney | 166/306 X |
| 2,783,986 | 3/1957 | Nelson et al. | 299/6 |
| 2,888,987 | 6/1959 | Parker | 166/245 |
| 3,285,335 | 11/1966 | Reistle, Jr. | 166/272 X |
| 3,386,508 | 6/1968 | Bielstein et al. | 166/303 X |
| 3,882,941 | 5/1975 | Pelofsky | 166/303 |
| 4,099,570 | 7/1978 | Vandergrift | 166/50 X |
| 4,099,783 | 7/1978 | Verty et al. | 299/2 |

FOREIGN PATENT DOCUMENTS

| | | | |
|---|---|---|---|
| 747984 | 4/1956 | United Kingdom | 299/4 |

OTHER PUBLICATIONS

Ranney, "The First Horizontal Oil Well", *The Petroleum Engineer,* Jun. 1939, pp. 25–30.

*Primary Examiner*—Stephen J. Novosad
*Assistant Examiner*—George A. Suchfield
*Attorney, Agent, or Firm*—Bard & Groves

[57] ABSTRACT

This invention relates to novel leaching methods and apparatus for recovering minerals such as ores, high viscosity oil, and the like, from the subsurface earth formation. More specifically, the formation is penetrated by a plurality of mine shafts or large-diameter boreholes which are spaced apart as a function of the lithological characteristics of the formation. Thereafter, a suitable leaching fluid such as a liquid solvent, steam, free hydrogen, or carbon dioxide is injected into the formation through a plurality of drill holes radially extending from the lower portions of the shafts.

In a particular technique for recovering high viscosity oil, the formation is initially subjected to a sequence of "soaking" cycles, wherein fluid is injected into the formation during separate discrete time periods, and wherein dissolved minerals or reduced viscosity oil is drained from the drill holes during the interval following each injection period. Thereafter, fluid is continually injected into some or all of the radials extending from selected ones of the shafts to "sweep" the formation, while dissolved ores or oil is drained from the remaining radials extending from the same or other shafts.

16 Claims, 9 Drawing Figures

FIG. 1
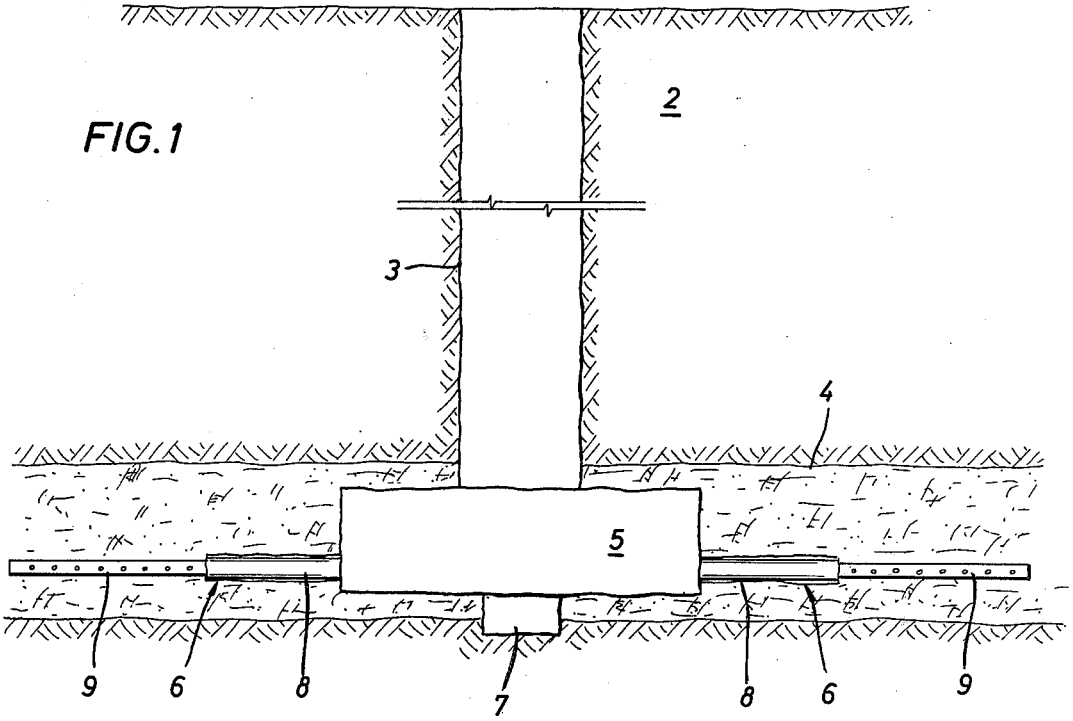
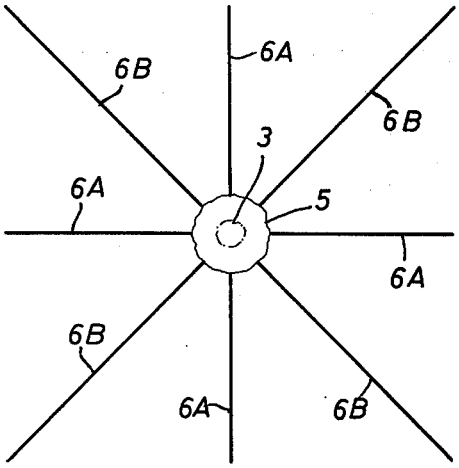
FIG. 2
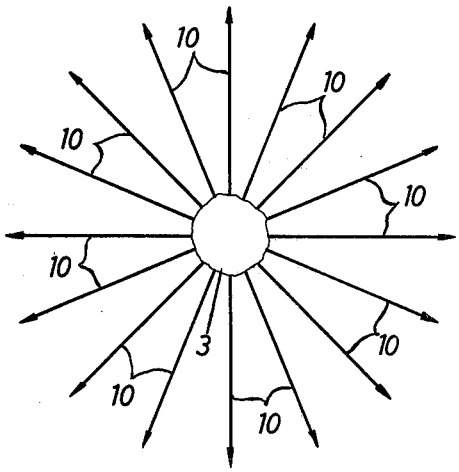
FIG. 4

FIG. 3
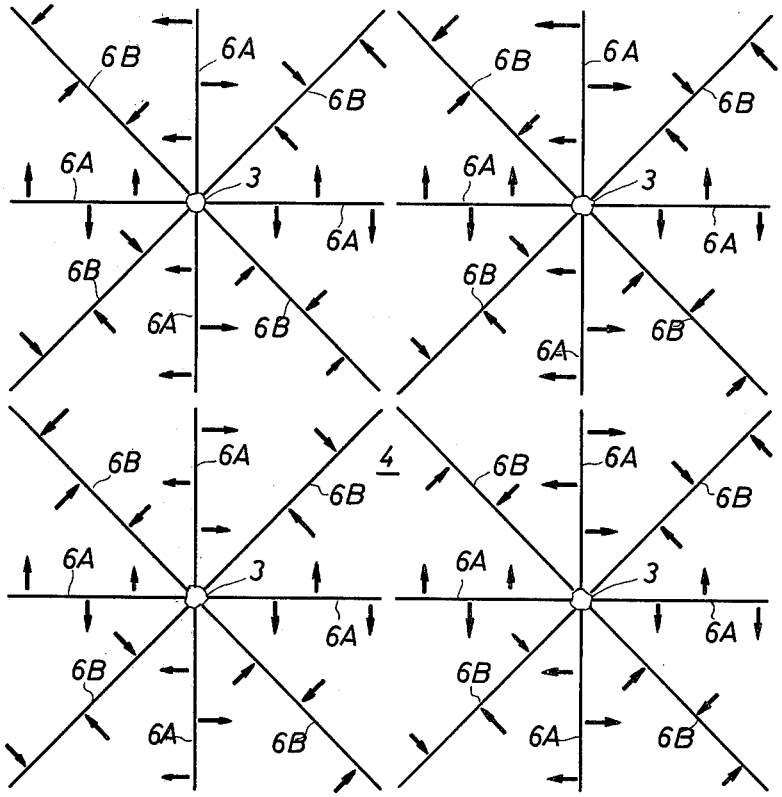
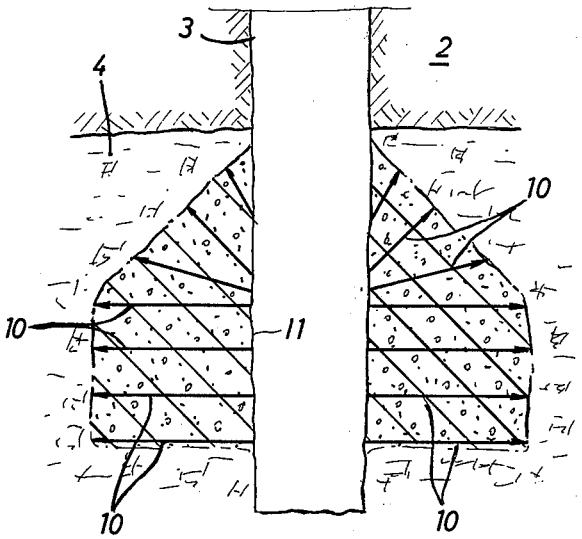
FIG. 5
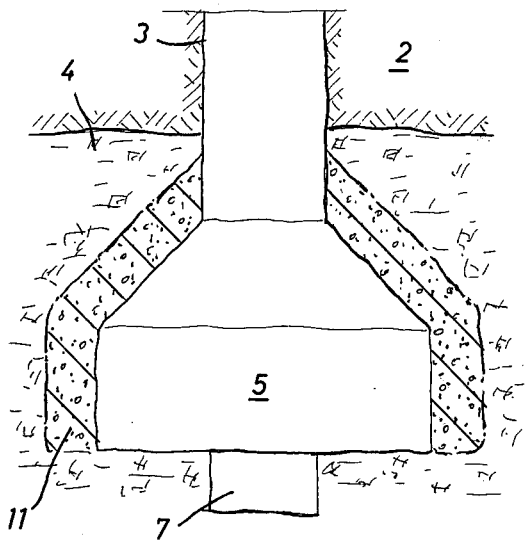
FIG. 6

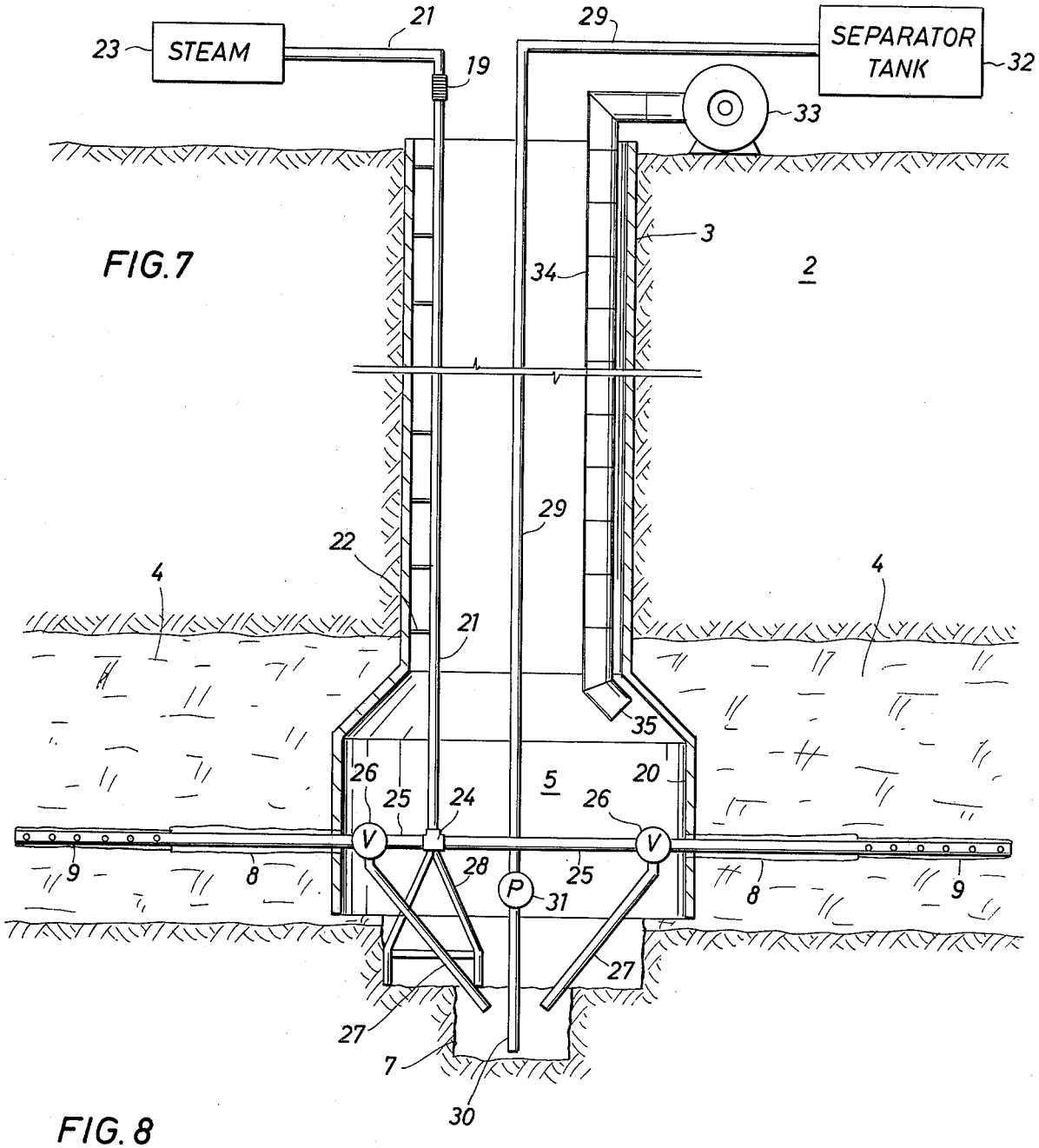
FIG. 7
FIG. 8
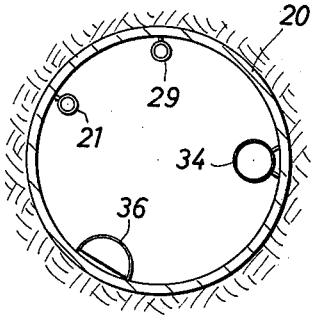
FIG. 9
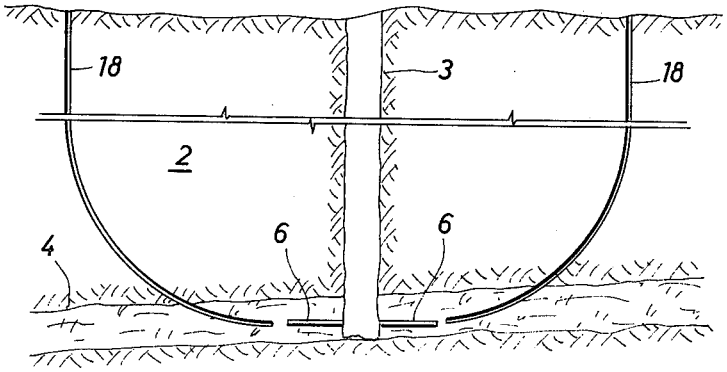

METHOD FOR RECOVERING SUBSURFACE EARTH SUBSTANCES

BACKGROUND OF INVENTION

This invention relates to methods and apparatus for recovering minerals and hydrocarbons from subsurface earth formations, and more particularly relates to improved leaching methods and apparatus for recovering solid and semi-solid and viscous liquid earth materials such as kerogen, high viscosity oil, inorganic ores and the like.

The term "leaching" generally means a process wherein a suitable fluid is percolated through an aggregate mixture of solid materials, and whereby the leaching fluid dissolves and carries away certain selected constituents of the mixture. Thus, subsurface salt deposits may be mined by pumping water down through boreholes extending into the strata of interest, and by thereafter recovering the resulting brine solution. Similarly, subsurface ore bodies may be mined by leaching the strata or interest with an appropriate solvent.

In a larger sense, however, the term "leaching" may conveniently be used to characterize any process or technique wherein a fluid is precolated through such an aggregate of solid or semi-solid materials, to liquify selected ones of such materials, and whereby the substances thus treated are then capable of flowing through and separating from the original mixture. For example, it is well known that sulfur can be "leached" from subsurface earth formations lying at depths which preclude commercial recovery by conventional mining operations. Sulfur is almost completely insoluble in water, but its melting point is only slightly above the boiling temperature of water. Thus, water, "super-heated" to a temperature corresponding to the melting temperature of sulfur, is injected into boreholes to liquify the sulfur, and the melted sulfur is then brought to the surface by conventional flow or pumping techniques.

Similarly, steam injection techniques are often used to recover solid and semi-solid petroleum substances from subsurface earth formations. It is well known that oil and gas are conventionally recovered through boreholes drilled into the formations, whereby pressure in the formation causes the oil to percolate through the rock matrix and into the borehole. If the formation contains kerogen or bitumen, however, or even oil having an abnormally high viscosity, the flow rate of such materials is insufficient to permit their recovery in commercial quantities.

Water is not a solvent for petroleum substances, of course, but it is also well known that oil and the like may be heated to reduce its viscosity. Thus, steam, hot water, hot gaseous hydrogen or carbon dioxide, and the like, may be injected into the formation to heat the oil trapped therein, and to reduce its viscosity to a more desirable level. Although some interaction will occur between the hydrogen and the carbon molecules of the oil, the primary function of the fluid injected for this purpose is to heat the oil, and to increase the in situ pressure of fluids contained in the formation, thus increasing the rate of flow of the fluids through the formation, and thus a technique of this description constitutes "leaching" in the larger sense as hereinbefore explained.

The flow rate of viscous liquids through a porous rock formation depends on many factors, of course, as will be apparent from the following well-known relationship:

$$Q = 2\pi r\, b\, k \left[ \frac{\rho g}{\mu} \cdot \frac{\delta h}{\delta r} \right]$$

wherein Q represents flow rate, r is the radial distance from the center of the borehole to the point at which the hydraulic head (h) is measured, b and k represent the thickness and permeability of the formation, $\rho$ and $\mu$ represent the density and viscosity of the oil therein, and $\partial h/\partial r$ is a function of hydraulic gradient within the formation. For this reason, there are many large oil deposits which are well known to the industry but which have relatively little commercial value because the high viscosity of the oil and the low value of the hydraulic gradient does not permit recovery at a practical rate of flow.

It will be apparent from the foregoing relationship that if the viscosity of the oil could be lowered, or the hydraulic gradient in the formation increased, flow rate through the formation could be significantly increased and substantial additional oil recoveries would be achieved. For this reason, many attempts have been made to find or devise in situ production techniques or systems for reducing the viscosity of oil of this type or for increasing the hydraulic gradient in the formation or both. It is well known that the viscosity of oil is a function of its temperature, and thus most of these attempts have been directed toward heating the oil within the formation employing such methods that also directly or indirectly increase the hydraulic gradient in the formation.

Referring again to leaching techniques for the recovery of non-organic ores and minerals, it should be noted that most such substances of interest are substantially insoluble in water, and thus the term "leaching" clearly encompasses more than the use of a percolating solvent. For example, uranium occurs in the form of mixed oxides $UO_3$ and $UO_2$, which are commonly known as uraninite and carnotite, and which are substantially insoluble in water. If $UO_2$ is converted to the uranyl form ($UO_2$++), however, it will combine with chlorine to produce $UO_2Cl_2$ which is quite soluble. Accordingly, a uranium-bearing formation may be impregnated with a ferric chloride solution to produce the following in situ reaction:

$$UO_2 + 2FeCl_3 \rightarrow UO_cCl_2 + 2FeCl_2$$

Some of the uranium atoms at the interface of the ferric chloride solution and the uranium ore will experience an increase in valence to produce the uranyl radical, and it is these radicals which combine with the chlorine ions in the leaching solution to produce uranyl chloride by an oxidation-reduction reaction. Thus, the process is completed by withdrawing the dissolved uranyl chloride from the borehole, and by thereafter reducing the mixture to recover the uranium itself.

It will be apparent that copper and other such metals can be recovered in a similar manner, even though the particular substance is in the form of an insoluble oxide or other compound. The only requirement is that the formation be capable of impregnation by a leaching solution, and thus the ore of interest must be contained in a strata-type formation.

All of these techniques are, of course, subject to many disadvantages. In the case of steam injection to recover high viscosity oil and the like, it should be noted that formation contacted by the steam is only at the interface between the formation and the borehole, and thus production rates are inhibited for this reason. Even more serious, such techniques usually require as many as ten or more injector wells for each twenty-five acres of area, and heat losses by way of the steel well casings are accordingly substantial. In addition, steam injected into the formation from a conventional borehole will often override the oil in the formation and move directly into the producing wells, necessitating the immediate shutdown of such wells.

If the formation is injected with hot gases such as hydrogen, there is a greater tendency for the heated gas to penetrate more easily and deeply into the formation, and also less tendency for materials such as bentonite to expand and clog the pores of the matrix material. However, there is also a greater tendency for the gas to rise to the top of the formation, and to by-pass the oil therein, especially when the formation contains a fissure or other internal discontinuity.

These and other disadvantages of the prior art are overcome with the present invention, however, and novel and improved leaching techniques and apparatus are accordingly provided herein for more effectively and efficiently recovering ores, high viscosity oil, and other similar mineral substances from subsurface earth formations.

SUMMARY OF THE INVENTION

In an ideal embodiment of the present invention a vertical mine shaft and the like is bored or dug from the surface to the formation of interest, whereby personnel and equipment can reach the face of the formation. More particularly, the portion of the borehole across the formation is preferably enlarged laterally so as to provide a work chamber of a shape and size sufficient to permit operations to be conducted in an appropriate manner, subject to whatever shoring may be required under particular conditions. Thereafter, drill holes are bored laterally into the face of the formation and radially about the chamber, through which a suitable leaching fluid is thereafter injected into the formation by way of a conduit leading to the surface.

The particular spacing and arrangement of drill shafts will, of course, depend upon the size and lithology of the formation of interest, but it is a feature of the invention to provide approximately eight different radially extending drill holes for each shaft hole, and to further extend such drill holes to a point adjacent the ends of similar radials extending from an adjacent shaft hole. As will hereinafter be explained in detail, each group of radial drill holes will then define a rectangular pattern within the field, and thus the field may be effectively "covered" with a blanket of such rectangular patterns. The radials themselves will usually extend in a generally horizontal direction, although, if the formation pressure is sufficient, the radials may extend along the lateral axis of the formation. Alternatively, the radials may be positioned at a slight upward angle relative to their respective shaft hole, in order to accomodate gravity flow of the oil from the formation.

It is within the concept of the present invention to locate the radials adjacent the lower limit of the formation, whereby the leaching fluid injected therefrom will also tend to rise as well as travel laterally through the formation, and also to provide additional pluralities of such radial drill holes at other higher locations within thicker formations, whereby the formation adjacent the shaft hole may be more effectively heated. Furthermore, it is within the concept of this invention to inject leaching fluid through only part of each plurality of radials, while also taking fluid from one or more of the other radials extending from the same shaft hole. Thus, the minerals of interest which are relatively adjacent such shaft holes may be more effectively recovered, as well as providing better control over the pattern of sweep flow through the overall field.

PREFERRED EMBODIMENT

Although the leaching methods and apparatus of the present invention are suitable for the recovery of both inorganic and organic minerals, an embodiment of the invention is especially suitable for recovering high viscosity oil and the like. More particularly, the subject formation is penetrated by a plurality of large diameter shaft holes, as hereinbefore described, and a plurality of eight equally spaced apart drill holes are then drilled radially outwardly therefrom into the formation at distances such that the radials then define a rectangular pattern within the field.

Steam is then injected into the radials for a first discrete time interval depending upon the thickness and other lithological characteristics of the formation, and then the wells are "shut in" to trap the steam in the formation during a second discrete time interval, after which the radials are again opened for a third discrete time interval to allow the oil to enter the shaft well through the radials and be pumped to the surface. This completes a single steam-soak cycle. This "soak" technique is then repeated during one or more subsequent cycles, whereby the steam not only tends to penetrate further into the formation with each injection, but wherein the oil lying within the portion of the formation being soaked is caused to be heated gradually to the temperature sought to be achieved.

After the formation has been treated sufficiently by the "soak" technique, as thus described, steam may then be injected continually into some or all of the radials extending from selected ones of the shaft holes, while the remaining radials extending from the same or other shaft holes are opened to receive oil from the formation. Thus, steam is caused to sweep into the formation and across the field, to thereby more effectively produce the oil contained therein.

In conventional steam injection processes, wherein steam is injected into the top of a perforated steel well casing, the steel casing tends to drain away substantial amounts of heat sought to be applied to the formation. Since, in this embodiment of the invention, the radial drill holes through which steam is injected lie entirely within the formation, heat loss by way of the steel casing therein is not significant since the heat merely transfers to the formation sought to be heated. On the other hand, it is desirable for the steam to enter the formation at a distance from the shaft hole or chamber, so that the steam will tend to move outwardly therefrom instead of bypassing back into the chamber, and so it may be preferable to provide perforations or vents only in the outer or further portions of the casing within the radial drill holes. Furthermore, it may be preferable to insert preperforated pipe or casing into the radial drill holes, rather than to perforate the casing in a conventional manner after it has been inserted.

In another feature of the present invention, it should be noted that the sweep pattern or configuration of the steam injected into the field is a function of the location and spacing of both the shaft holes and the radial drill holes. In addition, the size, spacing and position of the perforations in the pipe or casing inserted in these lateral drill holes will also determine the pattern or configuration of the steam sweep in the formation.

A particular advantage of the present invention is that steam is not only injected directly into the formation without heat loss through the conventional well casing, but that the heat emanating from the injected steam is more effectively transferred to the oil within the formation. Accordingly, the effectiveness of the present invention is less dependent upon the permeability and other lithological characteristics of the formation, than is the case with the methods of the prior art.

Another advantage of the present invention is that the drill holes radially extending from the shaft holes may be selectively sized and positioned so as to more effectively sweep the formation with steam during the flood sequence than is the case with the methods and practices of the prior art, and whereby production of this type of oil is maximized.

These and other features and advantages of the present invention will become apparent from the following detailed description, wherein reference is made to the figures in the accompanying drawings.

IN THE DRAWINGS

FIG. 1 is a simplified pictorial representation partly in cross-section of a portion of an exemplary installation for recovering oil from a subsurface earth formation according to the concepts of the present invention.

FIG. 2 is another different functional representation of the installation suggested in FIG. 1.

FIG. 3 is a simplified functional representation of the overall installation suggested in FIGS. 1 and 2.

FIG. 4 is a simplified functional representation of a stage in the construction of the installation suggested in FIGS. 1–3.

FIG. 5 is another simplified functional representation of another stage in the construction of the installation suggested in FIGS. 1–3.

FIG. 6 is a further different functional representation of a third stage in the construction of the installation suggested in FIGS. 1–3.

FIG. 7 is a more detailed pictorial representation, partly in cross-section, of certain mechanical features of the installation suggested in FIGS. 1–3.

FIG. 8 is another view of the installation sought to be depicted in FIG. 7.

FIG. 9 is another simplified functional representation of an alternative installation embodying the concepts of the present invention.

DETAILED DESCRIPTION

Referring now to FIG. 1, there may be seen a simplified pictorial representation of one type of system embodying the concepts of the present invention for recovering heavy oil and the like from a subsurface earth formation, and depicting a substantially vertical mine shaft 3 or the like drilled from the surface of the earth 2 to and into a subsurface earth formation 4 of interest. More particularly, it may be seen that the shaft 3 is drilled completely through the formation 4, and is thereafter excavated laterally within the formation to provide a work chamber 5 with a sump hole 7 in the floor of the chamber 5 immediately below the lower end of the shaft 3. As may be seen in FIGS. 1 and 2, the radial lines 6 are thereafter drilled into the earth formation 4 from the wall of the chamber 5, preferably at or adjacent the lower limits of the formation 4.

Referring again to FIG. 1, it may be seen that the portion of the radials 6 extending from the wall of the chamber 5 may be suitably provided with so-called "surface" casing 8, with the outer end of the casing 8 thereafter provided with preperforated drain line pipe 9. The walls of the shaft 3 may be conveniently sealed with sections of bolted or welded steel casing 20, as hereinafter depicted in FIG. 7, or it may be lined with an appropriate material such as Gunite, to prevent caving or other collapse of the walls of the shaft 3. The diameter of the shaft 3 is preferably of a size sufficient to accommodate the passage of men and equipment from the surface of the earth 2 to the interior of the work chamber 5. Accordingly, the shaft 3 may be constructed by various conventional means, such as by drilling with a large diameter auger (not depicted), or by conventional excavation, depending upon the character of the various strata of the earth 2 lying above the formation 4 of interest.

Referring now to FIG. 7, there may be seen a more detailed pictorial representation of the installation functionally represented in FIG. 1, and showing that the shaft 3 has been underreamed or enlarged to provide the chamber 5, and then has been provided with a steel liner 20 throughout the length of the shaft 3 and the walls of the chamber 5. More particularly, surface equipment is represented as including a source of live steam 23 or other heating means having its discharge line 25 extending down to the chamber 5 to a junction 24 having steam lateral lines 25 interconnected with each radial 6 by means of a two-way control valve 26. The steam line 21 may conveniently be supported in the shaft 3 by means of a plurality of brackets 22 interconnecting the steam lines 21 to appropriate locations along the length of the steel liner 20, and the assembly composed of the steam line 21 and junction 24 may be further supported within the chamber 5 by a suitable support assembly 28 positioned on the floor of the chamber 5.

Referring again to FIG. 7, it may be seen that the installation also includes an oil collection line 29 having its lower intake portion 30 positioned at or adjacent the bottom of the sump 7, and having its upper end running to the surface of the earth 2 for interconnection with a conventional separator tank 32, with the usual assembly of tank batteries and other apparatus not specifically depicted in FIG. 7. As will hereinafter be explained in detail, oil is intended to be accumulated in the sump 7, and thus the collection line 29 is preferably provided with a suitable pump 31 for lifting oil from the sump 7 through the collection line 29 to the separator 32 and other surface equipment.

Referring again to FIG. 7, it will be apparent that if personnel are expected to operate within the chamber 5 for any extended period of time, ventilation of the interior of the chamber 5 is required. Accordingly, an air line 34 is preferably extended down through the shaft 3, with its upper end connected to an appropriate blower 33 at the surface, and with its lower discharge vent 35 appropriately positioned within the chamber 5. In addition, a caged or shield ladder 36 or other suitable means may be included to permit workmen to enter and depart from the chamber 5.

It will be apparent that both the oil collection line 29 and the air line or duct 34 must also be supported within the shaft 3. Accordingly, and as more particularly suggested in FIG. 8, it will be seen that the oil line and air duct 34 may also be connected to the steel liner 20 by appropriate brackets in the same or substantially the same manner as hereinbefore stated with respect to the steam line 21.

Referring again to FIG. 7, it may be seen that the installation depicted therein is arranged primarily to inject steam from its steam supply 23 through the steam line 21 to and into each conductor casing 8 and drain line 9 within the formation 4, and that such injection should be continued for a preselected length of time such as three to four weeks. After steam injection has been terminated, the entire areal portion of the formation 4 will preferably be allowed to "soak" for an additional period, such as a week, during which the heated oil within the formation 4 should experience further reduction of its viscosity. Thereafter, the valve 26 for each radial line 6 is changed to its alternate position, whereby steam from the steam line 21 is interrupted, and wherein oil from the formation 4 may then drain into the perforated drain lines 9, and through the conductor casings 8 and valves 26 to discharge pipe 27 extending from each valve 26 and into the sump 7. Upon accumulation of a sufficient quantity of oil within the sump 7, the pump 31 may be activated to lift the oil through the collection line 9 to the separator tank 32 as hereinbefore stated.

It has been determined that the practices hereinbefore described will require at least one such installation for an area of approximately one million square feet, or approximately twenty-three acres, of the formation 4 of interest. Accordingly, and as more particularly depicted in FIG. 3, it will be seen that the present invention is more profitably employed by installing a plurality of such installations, and by operating such installations in a simultaneous manner, whereby the entire field can be drained in a systematic manner.

Referring now to FIGS. 4–6, respectively, there may be seen an illustration of various stages in the construction of the system hereinafter described. In particular, the shaft 3 is first drilled or excavated to an appropriate depth, and is thereafter lined with steel casing 20 as hereinbefore explained. However, the portion of the shaft extending across the formation 4 is preferably provided with sections of casing 20 which are bolted together, rather than being welded, and are further provided with appropriate holes for drilling six to ten foot long grouting holes 10 into the formation. After the grounting holes 10 are completed, concrete is injected into the earth by an appropriate grouting machine (not depicted) which will be located within the bottom of the excavated shaft 3. After a concreted area 11 has been provided as suggested in FIGS. 5 and 6, the bolted steel casing may be removed, and the chamber 5 may then be constructed by excavation in a conventional manner.

Referring again to FIG. 3, it will be noted that the length of the radials 6 will depend upon their relative position to each other, since it is intended that the radials function to eject steam in a uniform manner throughout a substantial portion of the formation 4. Accordingly, it is assumed that the area to be covered by each shaft 3 will be approximately twenty-three acres in extent, four of the radials 6 will be approximately four hundred ninety feet long, and four of the radials 6 will be approximately six hundred ninety feet long.

The position of the radials 6 within the formation 4 will usually depend primarily upon the character of the substance sought to be recovered. If the mineral is high viscosity oil, then the radials 6 will usually be aligned along and adjacent the lower side of the formation 4, even if the formation 4 lies at an angle with respect to horizontal, since the internal pressure within the formation 4 will drive the oil through the radials 6 and into the shaft 3. If the mineral of interest is salt, sulfur, or a metallic ore or the like, it may be convenient to extend the radials 6 in a horizontal direction from the shaft 3, and even tilted upwardly at a small angle, to facilitate gravity flow therethrough.

The diameters of the radials 6 will depend primarily upon the type of matrix composing the formation 4, as well as upon the viscosity of the oil sought to be recovered therefrom. The steam line 21 is preferably provided with insulation material such as asbestos, or an inert gas such as nitrogen, in order to minimize heat loss, and is preferably provided with a suitable expansion joint 19 adjacent its upper end, as depicted in FIG. 7.

Referring now to FIG. 9, there may be seen another simplified pictorial representation of an alternative embodiment of means suitable for practicing the present invention, wherein the central shaft 3 may be drilled from the surface of the earth 2 to and across the formation 4 of interest, and wherein arcing drill holes 18 which begin at locations spaced from the top of the shaft 3 extend down to and along the formation 4 towards the shaft 3. These arcing drill holes 18 may be used as steam injection lines, in lieu of the steam line 21 depicted in FIG. 7, with the central shaft 3 receiving oil from radials 6 extending therefrom into the formation 4 as hereinbefore explained.

Although the present invention has been heretofore discussed and illustrated primarily with respect to alternate steam injection and oil recovery through the central shaft 3, it will be apparent that conventionally completed production wells (not depicted) can be provided at appropriate locations relative to the shafts 3 depicted in FIG. 3. In such an arrangement, steam will then be injected through the steam line 21 into the formation 4 on a continuous basis, since oil can be recovered through these alternative production wells as hereinbefore explained.

As hereinbefore stated, it is within the concept of the present invention to inject steam and the like into one or more radials 6 extending from a particular shaft 3, while simultaneously receiving oil from one or more other radials 6 extending from the same shaft 3. Furthermore, this may be done for more than one shaft 3 at the same time, in order to more effectively sweep the formation 4 of interest. Referring again to FIG. 2, it will be seen that if steam is injected into radials 6A while radials 6B are opened to drain oil into the sump 7, the injected steam will tend to drive the oil into the collection points at the same time it heats the oil adjacent the shaft 3, and thus the area about the shaft 3 will be more effectively swept with steam and drained of oil. Referring now to FIG. 3, it may be seen that the rectangular pattern of the various groups of radials 6A–B will permit this technique to operate effectively with respect to larger areas of the field.

In addition, although reference has been continually made to the use of steam it should be noted that other heating or treating materials may be used. Instead of steam, therefore, other materials may be substituted such as hot water, free air, hydrogen, or carbon dioxide and the like, in operations to recover petroleum substances. Similarly, a suitable leaching fluid may be used to recover insoluble ores and other minerals, and such fluids may also be heated prior to injection in order to accelerate the chemical reaction sought to be obtained.

Other alternate forms of the present invention will suggest themselves from a consideration of the apparatus and practices hereinbefore discussed. Accordingly, it should be clearly understood that the systems and techniques depicted in the accompanying drawings, and described in the foregoing explanations, are intended as exemplary embodiments of the invention, and not as limitations thereto.

What is claimed is:

1. A method of recovering solid and semi-solid petroleum substances and the like from a subsurface earth formation, comprising establishing at least one substantially vertical shaft hole extending from the surface of the earth to said earth formation, forming a subterranean operating chamber connecting said shaft hole with said formation, drilling a plurality of boreholes extending substantially laterally and radially outward from said chamber into said formation, thereafter injecting steam down said one shaft hole and into said boreholes during a discrete steam injection cycle of predetermined duration to increase the temperature and pressure within the portion of said formation substantially surrounding said chamber and generally defined by the ends of said boreholes, and thereafter stoppering said boreholes and trapping said steam in said defined portion of said formation during a discrete steam soak cycle of predetermined duration to extend said temperature and pressure increase within said defined portion of said formation and to reduce the viscosity of said petroleum substances lying therewithin.

2. The method described in claim 1, further including the step of unstoppering and injecting additional steam down said one shaft hole and into said boreholes during subsequent discrete steam injection cycle of predetermined duration to further increase the temperature and pressure within said defined portion of said formation.

3. the method described in claim 2, further including the step of restoppering said boreholes and again trapping said steam within said defined portion of said formation and to further extend said temperature and pressure increase within and outwardly of said defined portion of said formation to reduce the viscosity of said petroleum substances adjacent said defined portion of said formation.

4. The method described in claim 3, further including the steps of establishing at least one other substantially vertical shaft hole extending from the surface of the earth to a point in said formation laterally displaced from said portion of said formation defined by the ends of said boreholes extending radially from said chamber and said one shaft hole, and receiving petroleum substances into said other shaft hole from said formation.

5. The method described in claim 4, wherein at least some of said boreholes are located adjacent the lower boundary of said formation for directing said injected steam both laterally and upwardly through said defined portion of said formation.

6. The method described in claim 5, wherein said boreholes are stoppered and restoppered within said chamber and adjacent the face of said formation for trapping said injected steam substantially entirely within said formation.

7. The method described in claim 6, wherein the duration of said steam injection and soak cycles is a function of the lithological characteristics of said formation and the viscosity of said petroleum substances lying within and adjacent said defined portion of said formation.

8. The method described in claim 7, wherein said boreholes are further located and extended within said formation to direct said increase in temperature and pressure laterally through said formation toward said other shaft hole.

9. A method of recovering solid and semi-solid minerals from a field having a subsurface earth formation, comprising:

establishing a plurality of shaft holes extending from the surface of the earth to and across said formation of interest, each shaft hole having a cross-sectional size accommodating passage of personnel therethrough, said shaft holes being spaced apart as a function of the lithographical character of the formation, enlarging each shaft hole laterally within said formation to establish an operating chamber at the lower end of each shaft hole, drilling a plurality of boreholes radially and laterally extending from each chamber into said formation and defining a rectangular pattern therein relative to each shaft hole, covering the field with a blanket of rectangular patterns by extending the boreholes of each shaft hole to points adjacent the ends of similar boreholes of other shaft holes, injecting steam during a first discrete time interval through selected ones of said boreholes and into said formation, trapping the steam in the formation during a second discrete time interval, and withdrawing fluid through selected ones of said boreholes and said formation during a third discrete time interval.

10. The method described in claim 9, wherein said boreholes are located adjacent the lower limit of said formation.

11. The method described in claim 10, further including the steps of collecting at least a portion of said fluid withdrawn from said formation within at least one shaft hole, and lifting said collected fluid through said one shaft hole to the surface.

12. The method described in claim 11, wherein said withdrawn fluid is collected in said one shaft hole substantially concurrently with said injection of steam into said boreholes.

13. The method described in claim 9 wherein said formation is subjected to a sequence of soaking cycles by conducting said injecting step and said trapping step in repetitive fashion.

14. The method described in claim 9 including selecting at least one shaft hole for withdrawing fluid, and withdrawing fluid driven to said one shaft hole by said sequence of soaking cycles from said one shaft hole.

15. The method described in claim 9 including selecting at least one shaft hole remote from the other of said shaft holes for withdrawing fluid, subjecting said formation to a sequence of soaking cycles by conducting said injecting step and said trapping step in repetitive fashion with respect to at least one of said shaft holes, driving fluid in said formation towards said one shaft hole, and withdrawing fluid from said one shaft hole.

16. The method described in claim 15 wherein a plurality of said other of said shaft holes are selected for subjecting said formation to said sequence of soaking cycles.

* * * * *